US005493103A

United States Patent [19]

Kuhn

[11] Patent Number: 5,493,103

[45] Date of Patent: Feb. 20, 1996

[54] BAKING UTENSIL TO CONVERT MICROWAVE INTO THERMAL ENERGY

[76] Inventor: James O. Kuhn, 140 Nassau St., New York, N.Y. 10038

[21] Appl. No.: 173,784

[22] Filed: Dec. 27, 1993

[51] Int. Cl.[6] ..... H05B 6/80

[52] U.S. Cl. ..... 219/730; 219/729; 219/732; 99/DIG. 14

[58] Field of Search ..... 219/730, 732, 219/729, 734, 735; 99/DIG. 14; 426/234

[56] References Cited

U.S. PATENT DOCUMENTS

| | | | |
|---|---|---|---|
| 4,190,757 | 2/1980 | Turpin et al. | 219/730 |
| 4,362,917 | 12/1982 | Freedman et al. | 219/730 |
| 4,398,077 | 8/1983 | Freedman et al. | 219/729 |
| 4,454,403 | 6/1984 | Teich et al. | 219/730 |
| 4,661,672 | 4/1987 | Nakanaga | 219/729 |
| 4,663,506 | 5/1987 | Bowen et al. | 219/730 |
| 4,703,149 | 10/1987 | Sugisawa et al. | 219/729 |
| 4,713,510 | 12/1987 | Quick et al. | 219/730 |
| 5,019,680 | 5/1991 | Morino et al. | 219/730 |

*Primary Examiner*—Philip H. Leung
*Attorney, Agent, or Firm*—Michael Ebert

[57] ABSTRACT

A baking utensil adapted to operate in a microwave oven to convert microwave energy to which the utensil is exposed into thermal energy for cooking food contained therein. The utensil is composed of complementary, thermally-conductive upper and lower sections, each having bonded to its outer surface an epoxy matrix layer. Dispersed throughout the matrix layer are ferrite particles which absorb microwave energy to produce thermal energy that is conducted by the sections of the utensil to the food enveloped thereby. The Curie point of the ferrite particles is such as to arrest their absorption of microwave energy when the utensil temperature approaches a level which is excessive for the food product being cooked or baked.

6 Claims, 1 Drawing Sheet

BAKING UTENSIL TO CONVERT MICROWAVE INTO THERMAL ENERGY

BACKGROUND OF INVENTION

1. Field of Invention

This invention relates generally to baking utensils, and more particularly to a utensil adapted to operate in a microwave oven to convert microwave energy to which the utensil is exposed to thermal energy for cooking the food contained therein.

2. Status of Prior Art

Baking is the process of cooking food with dry heat. Heat is transferred to the food by convection, conduction or infrared radiation, depending on the nature of the oven. But in all cases, thermal energy is applied to the outer surface of the food and by reason of heat transfer from this surface to the inner body of the food, cooking takes place from the outside in. As a consequence, as cooking continues, the surface of the food may become scorched or browned. Because this action usually renders the food more palatable, such surface scorching or browning is normally regarded as desirable.

The use of a microwave oven to heat or cook food is commonplace, and microwave ovens are now installed in many households. In the typical microwave oven, a magnetron functions to generate microwave energy at a frequency of about 1000 mHz. This energy is conveyed by a wave guide to the interior of the oven to irradiate the food placed therein. Because food more or less absorbs microwave energy, this gives rise to internal molecular friction which heats the food at a rate that depends on its "lossy" characteristics. Some food products are heated more rapidly than others in a microwave oven; but in general the cooking of food by microwave energy is much faster than by conventional heating techniques, including infrared radiation.

In heating or cooking food in a microwave oven, the food is placed in a receptacle of synthetic plastic, glass or other material which is non-reactive to microwave energy; hence, it is only the food that is heated. U.S. Pat. Nos. 4,703,149 and 4,416,906 disclose microwave food heating containers. In some cases, as pointed out in U.S. Pat. No. 4,416,906, microwave cooking of food is uneven because of dry spots in some areas of the food and moist spots in other areas.

Cooking takes place in a microwave oven throughout the body of the food; hence browning or scorching of the outer surface or crust does not occur. Thus if one sought to bake a loaf of bread in a microwave oven it would have no crust. This is a recognized disadvantage of microwave cooking.

U.S. Pat. No. 3,941,967 discloses a microwave cooking apparatus capable of scorching the surface of the food being cooked without excessively heating the interior of the food. This apparatus, which is designed to be put into a microwave oven, is in the form of a casing within which is disposed a plate on which the food to be cooked is placed. Below the plate is a thermal heating element which generates heat by absorption of microwave radiation, use for this purpose being made of a ferrite ceramic. Thus, the interior of the food is heated by the microwave energy absorbed thereby, while at the same time the exterior of the food is thermally heated and scorched by the plate heated by the ferrite heating element.

A similar arrangement is shown in U.S. Pat. No. 4,496,815, in which a microwave browning utensil includes a metal platter on which the food to be heated in the microwave oven is placed. On the underside of the platter is a thermal heating element formed by powdered ferrite dispersed in a matrix of organic material. In this way, the interior of the food on the platter which absorbs microwave energy is heated and cooked, while its exterior is thermally heated and browned. Thermal heating takes place mainly by conduction; hence, the exterior of a body being heated is first subjected to the heat before it penetrates the interior of the food body, whereas with microwave heating, the radiation penetrates the interior of the body.

U.S. Pat. No. 4,266,108 discloses the use of ferrite material adjacent a microwave reflecting member in which the ferrite material acts as a heating element that will rise in temperature to a predetermined level which depends on the Curie point of the ferrite.

The Curie point of a ferrite is the temperature value marking the transition between ferromagnetism and paramagnetism. When in its ferromagnetic state, the ferrite then absorbs microwave energy and is heated thereby. This action ceases when the ferrite enters its paramagnetic state. Hence, when a ferrite heating element is placed in a microwave oven and is subjected to microwave energy, the heating element will become increasingly hot until an elevated temperature is reached that depends on the Curie point of the ferrite, after which no more heat is generated even though the microwave oven is still operating. Thus, the ferrite heating element will effectively be turned "off," even though the microwave oven is still "on."

In the above-noted prior art arrangements which make use of ferrite heating elements, cooking is effected primarily by means of microwave energy, the thermal energy generated by the microwave-absorbing ferrites serving only to brown or scorch the surface of the food. Hence cooking takes place effectively from the inside out except for the thermal energy applied only to the outer surface of the food in the relatively brief period in which microwave cooking is in progress.

In other words, if in order to cook a particular food product with microwave energy in a microwave oven, the microwave cooking time is 5 minutes, and the microwave oven timer is so set, then at the end of 5 minutes, the microwave-absorbing thermal energy element will be turned off even though browning of the food has not yet been effected.

SUMMARY OF INVENTION

In view of the foregoing, the main object of this invention is to provide a baking utensil adapted to envelop the food to be cooked and when exposed in a microwave oven to microwave energy, then converting this energy into thermal energy that is transferred to the food and cooks the food from the outside in as in a conventional oven.

A significant feature of a utensil in accordance with the invention is that is effectively shields the food enveloped thereby from microwave energy so that the food is cooked from the outside in, and its outer surface may be browned or scorched as it would be had the food been cooked for a longer period in a conventional convection or other oven.

In a conventional oven, the electric or gas heating element heats the entire interior of the oven, heat energy being transferred to the food held in a utensil placed within the interior. Hence a substantial portion of the heat energy generated by the heating element is wasted. In a utensil in accordance with the invention, the utensil itself, when exposed to microwave energy, generates thermal energy which is directly transferred to the food enveloped by the utensil, relatively little thermal energy being wasted.

Also an object of the invention is to provide a durable baking utensil of the above type which operates effectively and is easily cleaned, and which can be manufactured at relatively low cost.

Still another object of the invention is to provide a stand for supporting a pair of baking utensils in a microwave oven, so that two cakes or other food products can be concurrently baked.

Briefly stated, these objects are accomplished in a baking utensil adapted to operate in a microwave oven to convert microwave energy to which the utensil is exposed into thermal energy for cooking food contained therein. The utensil is composed of complementary thermally-conductive upper and lower sections, each having bonded to its outer surface on epoxy matrix layer. Dispersed throughout the matrix layer are ferrite particles which absorb microwave energy to produce thermal energy that is conducted by the section of the utensil to the food enveloped thereby, the food being cooked from the outside in. The Curie point of the ferrite particles is such as to halt their absorption of microwave energy when the utensil temperature approaches an excessive level.

BRIEF DESCRIPTION OF DRAWING

For a better understanding of the invention as well as other objects and features thereof, reference is made to the following detailed description to be read in conjunction with the accompanying drawing wherein.

DETAILED DESCRIPTION OF INVENTION

The Utensil

Figure 1:
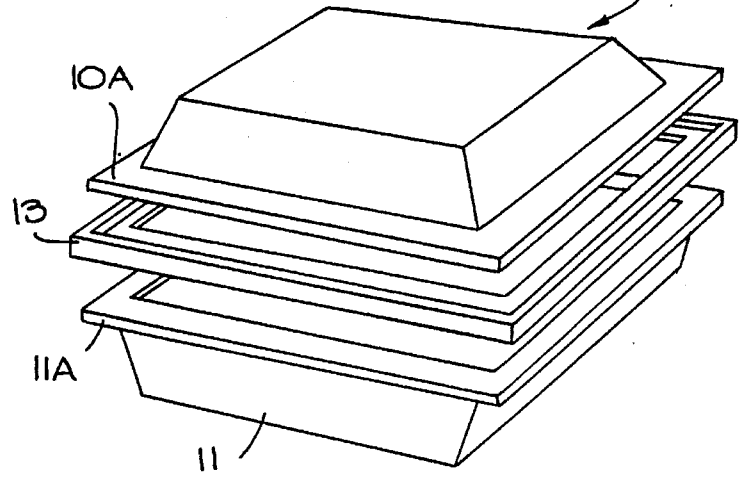
FIG. 1 is an exploded view of a utensil in accordance with the invention.

Referring now to FIG. 1 of the drawing, it will be seen that a microwave cooking utensil in accordance with the invention includes complementary upper and lower half sections 10 and 11, each in the form of a generally rectangular tray provided with a flange 10A and 11A, respectively.

Figure 2:
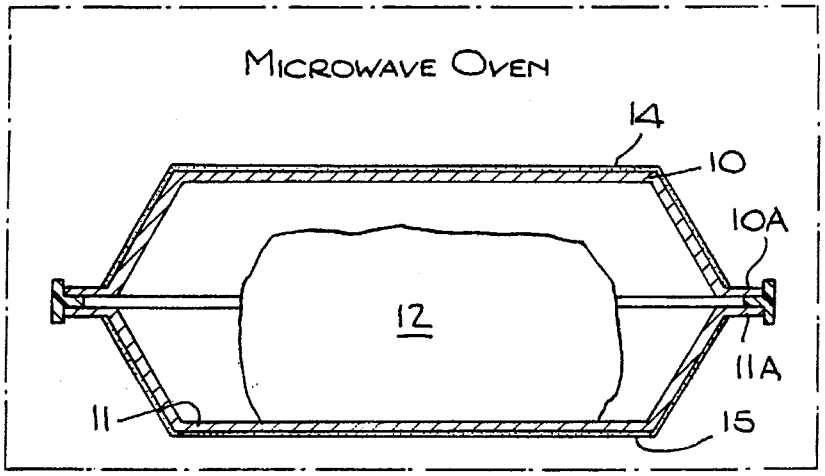
FIG. 2 is a section taken through the utensil.

When the upper and lower half sections 10 and 11 are combined to complete the utensil, as shown in FIG. 2, to envelop a food product 12 placed within the utensil, flange 10A of the upper section then is superposed over flange 11A of the lower section. Sandwiched between flanges 10A and 11A is a frame-shaped spacer 13 formed of polypropylene or other dielectric material to prevent sparking between the flanges when the utensil is exposed to microwave energy in a microwave oven. In practice the corners of the flanges and the frame are preferably rounded, for sharp edges are to be avoided in a microwave oven.

While the utensil illustrated herein is shown as being composed of a pair of rectangular tray-like sections, it is to be understood that the invention is by no means limited to this preferred embodiment, for a utensil in accordance with the invention, while it must have complementary upper and lower sections, these sections may be in a round, an octagonal or in any other shape. Thus the upper section of the utensil may take the form of a lid for a tray like lower section.

Bonded to the outer surface of the shaped upper section 10 of the utensil is a matrix layer 14 of epoxy resin material or any other dielectric material which is strongly adherent to the outer surface of the metal. Similarly bonded to the outer surface of the shaped lower section 11 of the utensil and conforming thereto is a matrix layer 15 of epoxy resin material. The advantage of an epoxy resin is that it is capable of surviving rough handling and should the utensil be dropped on a hard surface or otherwise mishandled, the epoxy layer will remain attached to the metal and will not crack.

Dispersed throughout the epoxy matrix layers 14 and 15 which are non-reactive to microwave energy, are fine ferrite particles P. These particles are highly reactive and absorb microwave energy. The term "ferrites" refers to magnetic oxides containing iron as a major component. It is the high electrical resistivity of ferrites that distinguish them from magnetic metals. The three most common groups of ferrites are those characterized as spinels, garnets and hexagonal ferrites. The spinel ferrites have the chemical formula $MeFe_2O_4$. The garnet ferrites have the general formula $3MeO_25Fe_2O_3$, while the composition of hexagonal ferrites include barium. Available ferrites have Curie points in the range of about 80° C. to over 500° C. The ferrite layers covering the sections of the metal sections shield the food contained in the utensil from microwave energy so that no microwave cooking takes place.

The ferrites dispersed in the matrix layers absorb microwave energy and produce thermal energy that is conducted by the metal upper and lower sections 10 and 11 to the food product 12 enveloped by the utensil to effect cooking of the product from the outside in. The Curie point of the ferrites is such as to cut off the production of thermal energy when its temperature approaches a level that is excessive for cooking the food product contained in the utensil.

In thermally cooking a particular food product whose cooking time is more of less known, there is no need to set the microwave oven timer so that the oven operates for a period just sufficient to effect thermal cooking of the food placed in the oven. In practice the microwave oven may be set for a time period beyond the anticipated cooking time, for when the energy produced by the utensil approaches an excessive level, because of the Curie point of the ferrites, the production of thermal energy cuts off automatically.

While a preferred embodiment of a cooking utensil in accordance with the invention has been disclosed, it will be appreciated that many changes may be made thereon without departing from the spirit of the invention. Thus use may be made of ferrites in the upper section of the utensil having a higher Curie point than these in the lower section so as to effect scorching of the upper surface of the food product. In practice, the utensil may be provided with ferrites whose Curie point is appropriate for a particular class of foods, such as cakes.

Safety Stand for Utensils

In some instances, it may be desireable to provide a pair of cooking utensils and a stand therefor so that the food products contained in the utensils can be concurrently cooked or baked in a microwave oven. Thus one may wish to bake a two-layer cake and to effect baking of both layers at the same time, one layer being baked in one utensil and the second layer in another.

Figure 3:
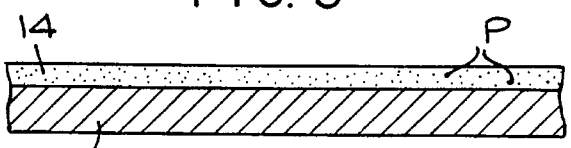
FIG. 3 is a section taken through the wall of a section of the utensil.
Figure 4:
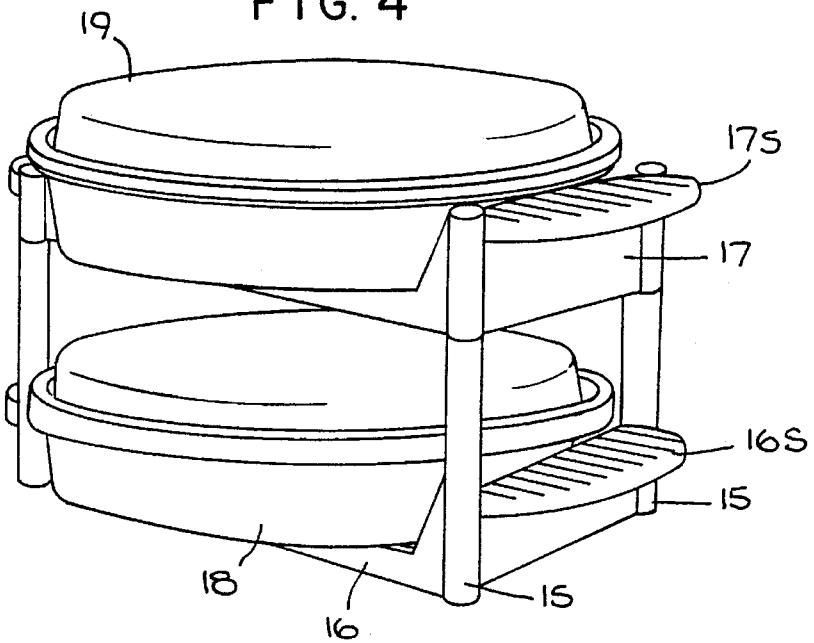
FIG. 4 illustrates in perspective a stand for supporting a pair of utensils one above the other in a microwave oven.

To this end, a stand, as shown in FIG. 4, is provided. The stand is composed of four upright posts 15 placed at the corners of a rectangle whose size is appropriate to the size of the utensils that are to be supported by the stand. The posts are joined to the corners of a generally rectangular base platform 16 and an upper platform 17 elevated directly above the base platform. Each platform is provided with a depression defining a seat for the utensil placed thereon, a utensil 18 in accordance with the invention being seated on platform 16 and a like utensil 19 being seated on platform 17. The platforms are provided at their ends with projecting ledges 16S and 17S respectively. These serve as handles for the stand, so that when the stand is loaded, it may then be placed in a microwave oven, or removed therefrom without risk.

The stand is preferably fabricated of a high-strength synthetic plastic material that is non-reactive to microwave energy. Hence when the loaded stand is placed in a microwave oven, microwave energy is then absorbed only by the ferrit particles dispersed in the matrix layers bonded to the upper and lower sections of the utensils to produce thermal energy that is transferred to the food product enveloped by the utensils.

It will be noted that in this instance the utensils have a round configuration. Because it is only the utensils which become hot in a microwave oven, and not the stand, when baking is completed and the utensils are still hot, one may remove the loaded stand from the oven without the risk of burning the fingers of the operator who grasps the handles of the stand.

In practice a stand adapted to support a single utensil may also be provided as a safety holder for this utensil, so that the utensil while still hot can be removed from the microwave oven.

It is not good practice to permit children to cook or bake food in a conventional gas or electric oven, for such ovens remain very hot after cooking is completed and there is a danger that a child will burn himself should he try to remove the cooked food from the hot oven. But with the present invention, when cooking is completed in a microwave oven and the oven is turned off, it is only the utensil that is still hot, and if the utensil is on a relatively cool safety stand, it may be removed from the oven without difficulty.

I claim:

1. A baking utensil adapted to operate in a microwave oven to convert microwave energy to which the utensil is exposed to thermal energy for cooking a food product contained in the utensil, the utensil comprising:

A. complementary upper and lower metal half sections, said sections, when combined, forming a container enveloping the food product to be cooked, the upper and lower sections each having a tray-like shape and being provided with a flange, the flange of the upper section being superposed over the flange of the lower section; and B. a matrix layer formed of a material substantially non-reactive to microwave energy bonded and conforming to the outer surface of the upper and lower sections to envelop the container, each layer having dispersed therein ferrite particles which absorb microwave energy to produce thermal energy to cook the food enveloped by the container whereby the food is cooked from the outside in as in a conventional oven, the upper and lower sections being formed of a metal having a high coefficient of thermal conductivity whereby the thermal energy produced by the layer is transferred to the food enveloped by the container, said ferrite particles having a Curie point that acts to cut off the production of thermal energy when its temperature approaches a level that is excessive for cooking the food enveloped by the container whereby no thermal energy is produced when cooking is completed.

2. A utensil as set forth in claim 1, in which the metal is zinc.

3. A utensil as set forth in claim 1, in which the metal is steel.

4. A utensil as set forth in claim 1, in which the matrix layer is formed of an epoxy resin.

5. A utensil as set forth in claim 1, further including a frame-shaped spacer of dielectric material interposed between the upper and lower flanges of the section to prevent sparking.

6. A baking utensil adapted to operate in a microwave oven to convert microwave energy for cooking a food product in the utensil, the utensil comprising:

A. complementary upper and lower metal half sections, said sections, when combined, forming a container enveloping the food product to be cooked; and B. a matrix layer formed of a material substantially non-reactive to microwave energy bonded and conforming to the outer surface of the upper and lower sections to envelop the container, each layer having dispersed therein ferrite particles which absorb microwave energy to produce thermal energy to cook the food enveloped by the container whereby the food is cooked from the outside in as in a conventional oven, the upper and lower sections being formed of a metal having a high coefficient of thermal conductivity whereby the thermal energy produced by the layer is transferred to the food enveloped by the container, the ferrite particles dispersed in said matrix layer enveloping the container having Cuire points that are appropriate to the food product being baked in the container so that no thermal energy is produced after baking is completed, the particles in the matrix layer conforming to the upper section of the container having a higher Curie point than the particles in the matrix layer conforming to the lower section of the container to effect scorching of an upper surface of the baked food product.

* * * * *